US008534470B1

(12) United States Patent
Lin et al.

(10) Patent No.: US 8,534,470 B1
(45) Date of Patent: Sep. 17, 2013

(54) DISASSEMBLABLE HANGING CART FOR FOLDING CHAIRS

(76) Inventors: Mei Chuen Lin, Taoyuan (TW); Tzu Mei Wang, Taoyuan (TW)

( * ) Notice: Subject to any disclaimer, the term of this patent is extended or adjusted under 35 U.S.C. 154(b) by 0 days.

(21) Appl. No.: 13/444,300

(22) Filed: Apr. 11, 2012

(51) Int. Cl.
*A47F 7/00* (2006.01)
*A47B 43/00* (2006.01)

(52) U.S. Cl.
USPC ..... 211/27; 211/13.1; 211/189

(58) Field of Classification Search
USPC ..... 211/27, 204, 206, 193, 189, 13.1, 211/134, 182; 248/129, 150
See application file for complete search history.

(56) References Cited

U.S. PATENT DOCUMENTS

| | | | | |
|---|---|---|---|---|
| 584,811 | A * | 6/1897 | Caldwell | 211/134 |
| 1,306,297 | A * | 6/1919 | Auerochs | 211/10 |
| D182,483 | S | 4/1958 | Skinner | |
| 5,330,064 | A * | 7/1994 | Hall | 211/182 |
| 5,725,106 | A * | 3/1998 | Wilson | 211/13.1 |
| 5,833,083 | A * | 11/1998 | Miller | 211/134 |
| 5,862,924 | A | 1/1999 | Dumont | |
| 6,182,920 | B1 * | 2/2001 | Watkins | 242/594.4 |
| 6,659,495 | B1 * | 12/2003 | Sanderson | 280/651 |
| D491,330 | S * | 6/2004 | Violo | D34/21 |
| 6,817,478 | B2 | 11/2004 | Venegas, Jr. | |
| 7,270,339 | B2 * | 9/2007 | Feick | 280/79.3 |
| 2009/0065461 | A1 * | 3/2009 | Wang | 211/182 |
| 2010/0213149 | A1 * | 8/2010 | Shaha | 211/87.01 |

* cited by examiner

*Primary Examiner* — Jonathan Liu
*Assistant Examiner* — James Twomey
(74) *Attorney, Agent, or Firm* — Rabin & Berdo, P.C.

(57) ABSTRACT

A disassemblable hanging cart for folding chair includes a chassis, two standing poles, two reinforcement sets, and multiple hanging racks, bolts and pad sets. The chassis includes a plurality of caster sets. The two standing poles are vertically and symmetrically erected on opposite positions of the chassis. Each reinforcement set is provided between one of the two standing poles and the chassis for reinforcing the connection strength therebetween. Each hanging rack includes a cross beam, and a plurality of hanging bars for hanging folding chairs. The bolts connect the cross beams with the hanging bars. The pad sets are mounted to the hanging bars to prevent the folding chairs from falling off from the hanging cart. The hanging cart can be easily assembled, and when the hanging cart is not in use, it can be disassembled and packed in a minimum size.

16 Claims, 11 Drawing Sheets

DISASSEMBLABLE HANGING CART FOR FOLDING CHAIRS

BACKGROUND OF THE INVENTION

1. Field of the Invention

The present invention relates generally to a hanging cart for carrying and storing folding chairs, and in particular to a hanging cart for carrying and storing multiple folding chairs that is easy to assemble and disassemble.

2. The Prior Arts

Conventionally, manufacturers would stack folding chairs in piles and pack them in large corrugated cartons for transportation. However, after the folding chairs are taken out of the cartons and used, it is hard to find a space efficient and cost efficient way to move or store the folding chairs. Usually, dollies or carts are used for carrying or storing the folding chairs. The folding chairs are stacked on the dolly horizontally. However, the chairs are easily fallen out of the dolly while being moved from place to place. A stacking cart used for carrying or storing folding chairs includes a chassis and holding handles configured at two opposite sides of the chassis. Generally, folding chairs can be arranged in two ways, vertical way or horizontal way, on the stacking cart. According to the vertical way, a first folding chair is leaned upon one of the holding handles at first, and then a second folding chair is leaned upon the first folding chair, and then a third folding chair is leaned upon the second folding chair, and so on until a last folding chair is leaned upon another holding handle. The folding chairs accommodated on the stacking cart are stably held between the two holding handles by pressing to each other. The horizontal way is to place the folding chairs horizontally on the chassis and pile them up. The stacking cart can accommodate one pile or several piles of the folding chairs. If the chassis has a large area, the stacking cart can usually carry a lot of folding chairs.

However, no matter which way to accommodate the folding chairs, the conventional stacking cart does not have fence bars provided at lateral sides of the chassis for securing the folding chairs carried thereon. When the stacking cart is pushed to move on a bumpy floor, the folding chairs may fall off from the stacking cart down to the floor due to vibration. Although the conventional stacking cart can carry and store a lot of the folding chairs, it has to be carefully handled to prevent the folding chairs from falling off from the stacking cart while moving. Further, the chassis and the holding handles are usually welded together. When the stacking carts are transported from the manufactures to the retailers or carried from the retailers to the users, or when they are not in use, the cart cannot be disassembled. The stacking carts would occupy too much space and therefore it is inconvenient for delivery or storage.

Referring to FIG. 9, U.S. Pat. No. Des. 182,483 discloses another type of hanging cart for carrying and storing folding chairs. The hanging cart includes a chassis 91, two standing poles 92, a plurality of reinforcement sets 93 and two hanging racks 94. The chassis 91 includes a plurality of caster sets 915 disposed at the bottom of the chassis 91 for providing a stable support and moving function. The two standing poles 92 are vertically and symmetrically erected at opposite sides of the chassis. The two hanging racks 94 are mounted between the two standing poles 92 and located at different heights. The reinforcement sets 93 are disposed between the upper and lower hanging racks 94 to form a triangular truss structure and between the lower hanging rack 94 and the two standing poles 92. Thus, the reinforcement sets 93 are provided to enhance the strength of the hanging cart. Each of the hanging rack 94 includes a cross beam 941 and a plurality of hanging bars 942. Each of the cross beam 941 has two ends connected to the two standing poles 92. The hanging bars 942 perpendicularly and horizontally cross the cross beam 941, thereby connecting the hanging bars 942 with the cross beam 941. Both sides of the hanging bars 942 are adapted for hanging the folding chairs. Because the hanging bars are usually made of metal tubes, both ends of each hanging bars 942 are provided with enlarged heads 943 to protect the user from being injured by the ends of the hanging tubes. However, the folding chairs are easily fallen off from the horizontal hanging bars 942. Another type of improved hanging cart (not shown in drawing) has V-shaped hanging bars which incline upward from the cross beam.

Because the folding chairs are heavy and the hanging cart has to carry the folding chairs to move from place to place, the hanging cart for carrying and storing folding chairs needs to be built sturdily. Thus, the components of the conventional hanging cart for folding chairs are usually connected by welding; especially the truss structure of the reinforcement sets 93 and the horizontal or V-shaped hanging bars. When the hanging carts are transported from the manufactures to the retailers or delivered from the retailers to the users, or when they are not in use, the welded hanging carts can not be disassembled. The hanging carts would occupy too much space and therefore it is inconvenient to deliver or store. Moreover, the hanging cart having the horizontal hanging bars has a disadvantage, which the folding chairs are easily fallen off from the hanging cart. The hanging cart having the tilted hanging bars is difficult to manufacture, which increases the manufacturing cost.

SUMMARY OF THE INVENTION

A primary objective of the present invention is to provide a hanging cart for folding chairs for overcoming the disadvantage of the conventional designs that the folding chairs are easily fallen out of the cart, so that the folding chairs won't be damaged and staff won't be injured by fallen folding chairs.

Another objective of the present invention is to provide a disassemblable hanging cart for folding chairs that is easy to assemble and disassemble. Thus, when the hanging cart is not in use, the hanging cart can be disassembled to make it easy to store.

In order to achieve the objectives mentioned above, the present invention provides a disassemblable hanging cart for carrying and storing folding chairs. The disassemblable hanging cart includes a chassis, two standing poles, two reinforcement sets, and a plurality of hanging racks, bolts and pad sets. The chassis includes a plurality of caster sets distributed in different positions of the chassis for providing a stable support for the disassemblable folding chair hanging cart. The two standing poles are vertically and symmetrically erected on opposite positions of the chassis. Each of the two standing poles is configured with a plurality pairs of assembly portions corresponding to each other. The assembly portions of each standing pole are configured at different heights and positions. Each reinforcement set is provided between one of the two standing poles and the chassis for reinforcing the connection strength therebetween. Each hanging rack includes a cross beam and a plurality of hanging bars. Each cross beam has two opposite ends. The hanging bars of the hanging rack are perpendicularly and horizontally crossover the cross beam. The hanging bar and the cross beam include vertical through holes aligned to each other and allowing the bolt to be inserted into the vertical holes, thereby connecting the hanging bar with the cross beam. The opposite ends of each cross beam are correspondingly assembled with the assembly portions of the standing poles, so that the cross beams are assembled to the standing poles at different heights. Each of the pad sets is mounted to at least one of the hanging bars. When the folding chairs are hung on the hanging cart, the folding chairs are rest on the covering pads.

Both sides of the hanging bars are adapted for hanging up folding chairs. In operation, according to the size of the folding chairs to be hung, two or three immediately adjacent hanging bars are used for hanging one folding chair. The pad sets may be replaced according to the sizes of the folding chairs. When the folding chairs are hung on two immediately adjacent hanging bars, the pad set that is mounted to two hanging bars is used. When the folding chairs are hung on three immediately adjacent hanging bars, the pad set that is mounted to three hanging bars is used. In such a way, the disassemblable folding chair hanging cart can be used for carrying and storing a plurality of folding chairs in different sizes at the same time.

According to an aspect of the present invention, every part of the disassemblable hanging cart for folding chairs is adapted to be assembled and disassembled conveniently. Therefore, when the disassemblable hanging cart for folding chairs is going to be stored, it can be disassembled into independent parts, which are convenient for storage and delivery. When the disassemblable hanging cart for folding chairs is going to be used again, it can be reassembled conveniently.

According to a further aspect of the present invention, the friction forces between the folding chairs and the pad sets are larger than that between the folding chairs and the hanging bars. Therefore, the hanging cart for carrying and storing folding chairs according to the present invention can prevent the folding chairs from falling off from the hanging rack. Moreover, protective caps having extruded edges are provided at both ends of each hanging bar for interfering with the folding chair hanging thereon so as to prevent the folding chair from falling off therefrom.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
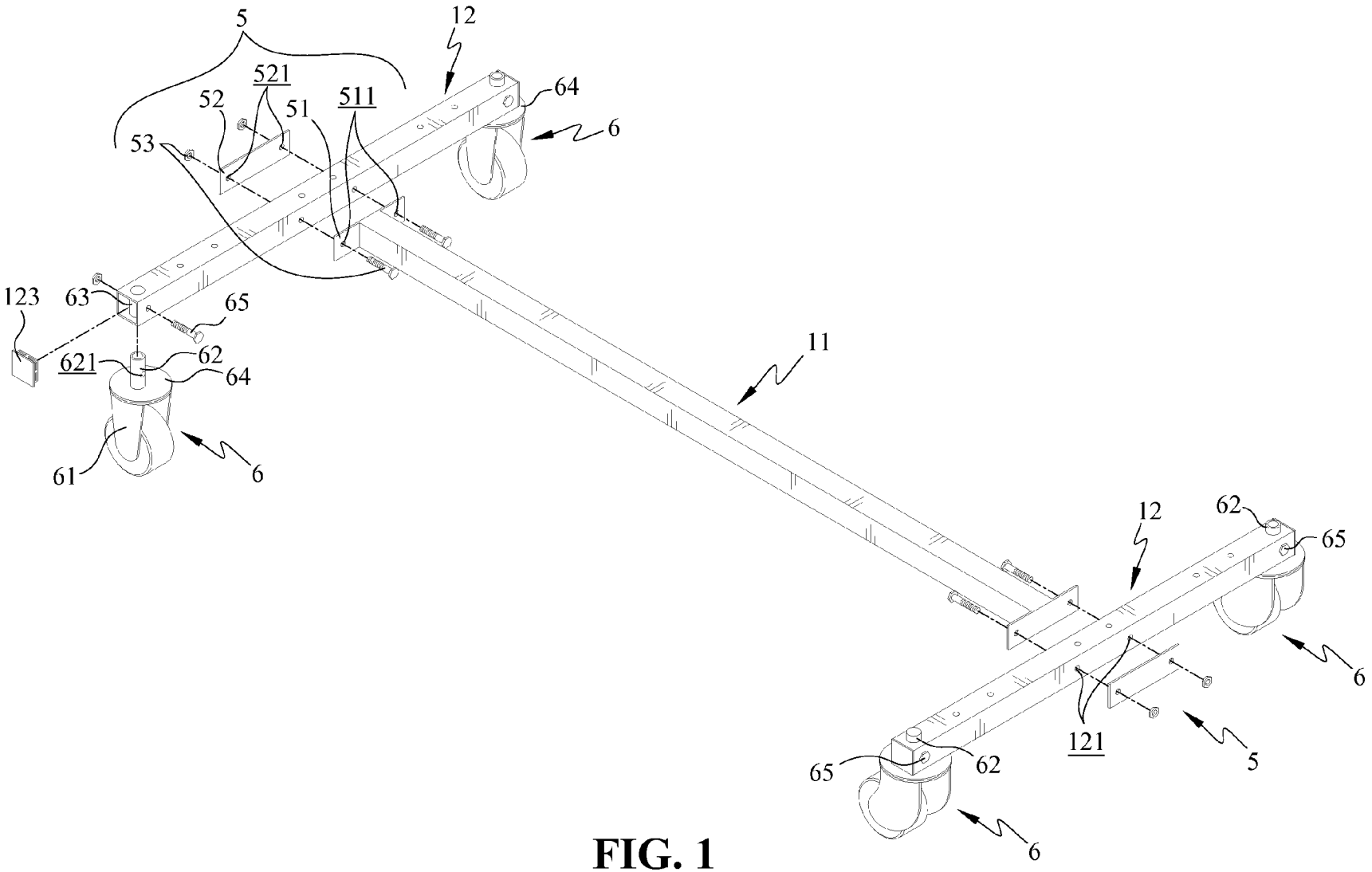
FIG. 1 is an exploded view showing a chassis of a hanging cart for carrying and storing folding chairs according to a first embodiment of the present invention.

The accompanying drawings are included to provide a further understanding of the invention, and are incorporated in and constitute a part of this specification. The drawing illustrates embodiments of the invention and, together with the description, serves to explain the principles of the invention.

Figure 6:
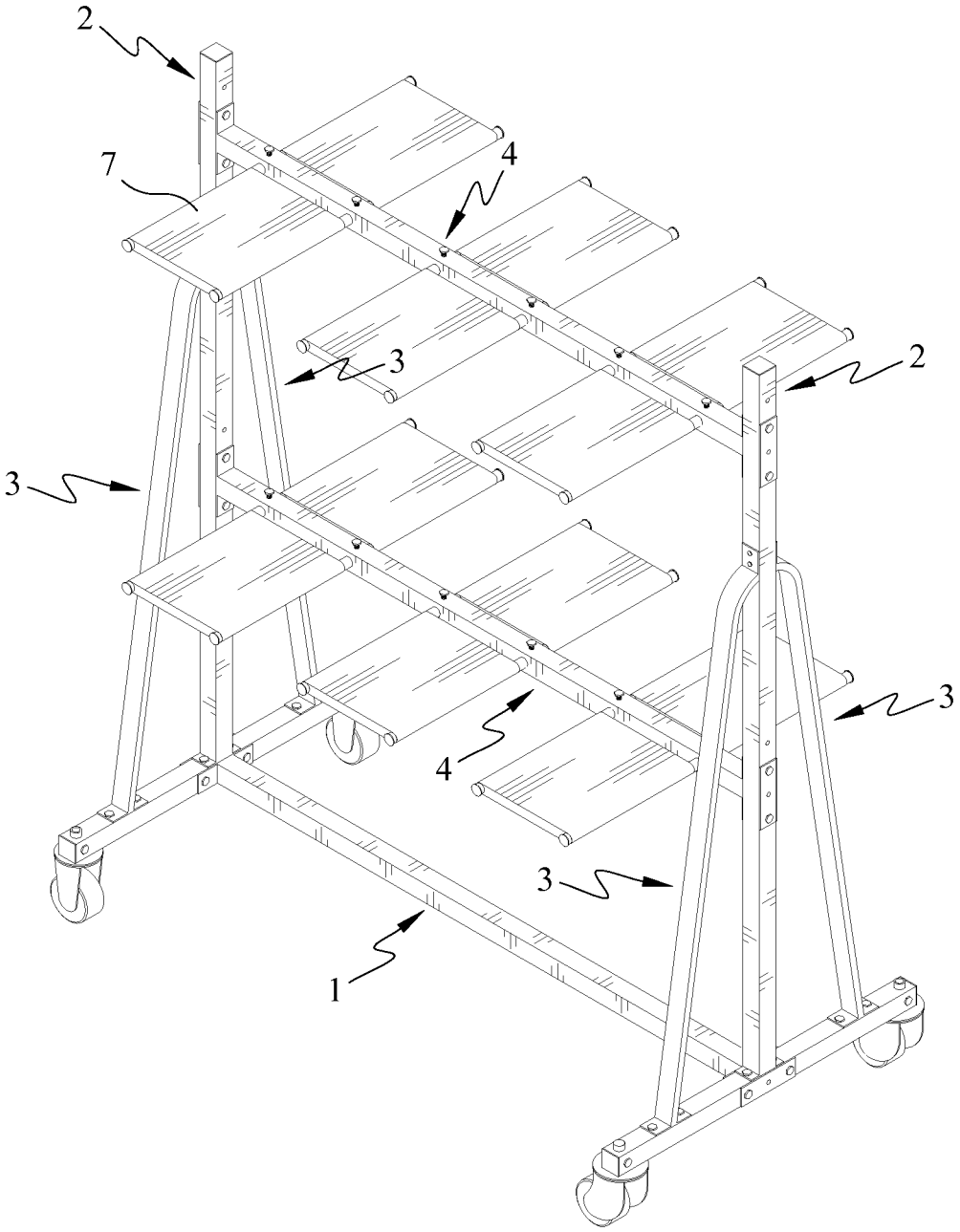
FIG. 6 is a perspective view showing the hanging cart for carrying and storing folding chairs according to the first embodiment of the present invention.

FIG. 6 illustrates a disassemblable hanging cart for carrying and storing folding chairs according to a first embodiment of the present invention. Referring to FIG. 6, the disassemblable hanging cart for carrying and storing folding chairs is mainly constituted of a plurality of stainless steel tube units, and generally includes a chassis 1, two standing poles 2, two reinforcement sets 3, a plurality of hanging racks 4, a plurality of caster sets 6 and a plurality of pad sets 7.

FIGS. 1 to 5 illustrate a step by step procedure of assembling the disassemblable hanging cart for carrying and storing folding chairs. All of the parts are designed for being assembled together for carrying or storing a plurality of folding chairs without specifically restricting the specific shapes or quantity of the tube units of each part.

FIG. 1 is an exploded view showing the connection of the chassis 1 according to the first embodiment of the present invention. Referring to FIG. 1, the chassis 1 includes a first primary rod 11 and two second primary rods 12. Preferably, the first primary rod 11 and the second primary rods 12 are made of structural tubing, such as square tubes, rectangular tubes or round tubes. FIG. 1 shows the first primary rod 11 and the second primary rods 12 are made of square tubes. The first primary rod 11 is located between the two second primary rods 12, thus configuring an "I" shaped architecture of the chassis 1. Both end sides of the first primary rod 11 are secured to the second primary rods 12 by fastener units 5, respectively. According to an aspect of the embodiment, the fastener unit 5 includes two side wing plates 51, a rectangular plate member 52, and two screw sets 53. The first primary rod 11 has two opposite end sides, and each of the two opposite end sides of the first primary rod 11 is connected to one of the two second primary rod 12 by the fastener unit 5. The two side wing plates 51 of the fastener unit 5 are perpendicularly welded to the end side of the first primary rod 11. The side wing plate 51 is configured with two through holes 511. Corresponding to the through holes 511 of the two side wing plates 51, the second primary rod 12 to be connected to the end side of the first primary rod 11 is also configured with two through holes 121. Preferably, the inner walls of the through holes 121 are made to configure inner threads. Further, the rectangular plate member 52 is configured with two through holes 521 respectively corresponding to the through holes 511 of the two side wing plates 51. Each of the screw sets 53 includes a threaded bolt and a threaded nut. The threaded bolts of the screw sets 53 are adapted for sequentially passing through the through holes 511 of the side wing plates 51, passing through the through holes 121 while matching with the inner threads configured at the inner walls of the through holes 121, and then passing through the through holes 521 of the rectangular plate members 52, and finally being engaged with the threaded nuts of the screw sets 53. In such a way, the fastener units 5 are used to secure the two second primary rods 12 to the two side ends of the first primary rod 11, thus configuring the "I" structure of the chassis 1.

In accordance with the first preferred embodiment of the present invention, both ends of each second primary rod 12 are provided with protective pads 123. The protective pads 123 are made of elastic or flexible materials, such as rubber and plastic. The protective pads 123 are adapted for protecting the user from being injured by the rigid end sides of the second primary rods 12. Further, the surface of each protective pad 123 is preferably configured with a protruded pattern for providing further protection to the protective pad 123 itself.

Further, the caster sets 6 are preferred to be swivel caster sets disposed at different positions of the chassis 1 for providing a stable support for the disassemblable hanging cart for folding chairs. In addition to a wheel, each caster set 6 includes at least one arm 61, a swivel-axle 62, a round hollow tube 63, and a gasket 64. The arm 61 is adapted for holding the wheel in place, and the swivel-axle 62 has a through hole 621 transversely configured through the swivel-axle 62. The round hollow tube 63 has a diameter slightly greater than that of the swivel-axle 62 and is erectly positioned inside the end side of the second primary rod 12 for receiving the swivel-axle 62 therein. As shown in FIG. 1, both of an upper surface and a bottom surface of the second primary rod 12 are configured with openings corresponding to the ends of the round hollow tube 63. The round hollow tube 63 is positioned such that the two ends of the round hollow tube 63 are aligned with the two openings of the second primary rod 12 at the upper surface and the bottom surface. A diameter of the openings is smaller than the diameter of the round hollow tube 63 and is slightly greater than the diameter of the swivel-axle 62.

Therefore, when assembling the caster set 6 to the second primary rod 12, the gasket 64 is sheathed over the swivel-axle 62. Then, the swivel-axle 62 is inserted into the round hollow tube 63 from the opening at the bottom surface of the second primary rod 12. Then, a threaded bolt 65 is passed from the second primary rod 12, through a side wall of the round hollow tube 63, and the through hole 621 of the swivel-axle 62 to the other side of the primary rod 12, and a corresponding threaded nut is used to engage the threaded bolt 65.

Figure 2:
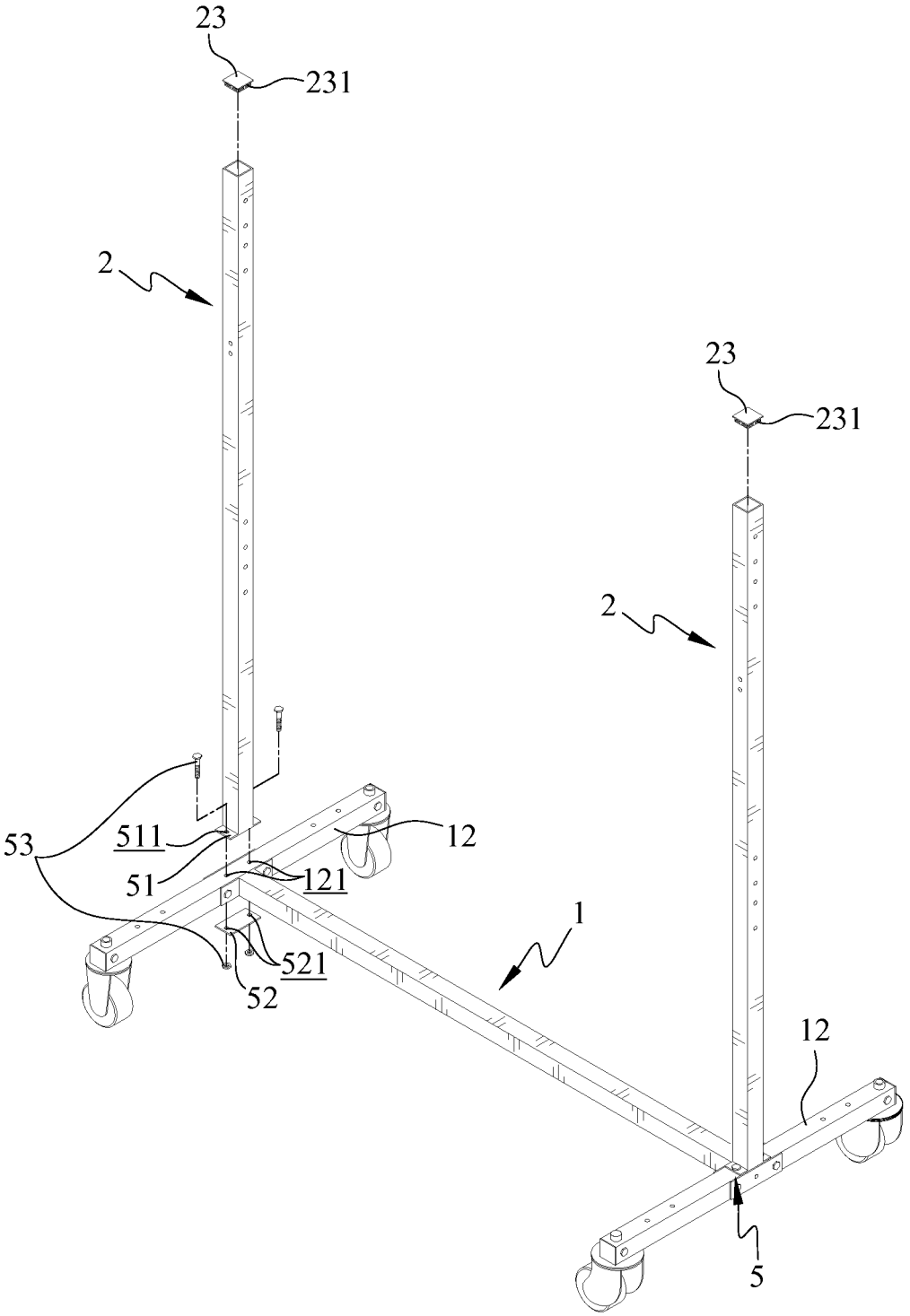
FIG. 2 is an exploded view showing the chassis and standing poles according to the first embodiment of the present invention.

FIG. 2 is an exploded view showing the connection of the chassis 1 and standing poles 2 according to the first embodiment of the present invention. Preferably, the standing poles 2 are made of structural tubing, such as square tubes, rectangular tubes or round tubes. As shown in FIG. 2, the standing poles 2 are made of square tubes. The standing poles 2 are uprightly secured to the chassis 1 and perpendicular to the first primary rod 11 and the second primary rods 12. Specifically, each standing pole 2 is secured to a corresponding second primary rod 12 by the fastener unit 5 as shown in FIG. 2. According to an aspect of the embodiment, the fastener unit 5 includes two side wing plates 51, a rectangular plate member 52, and two screw sets 53. Each of the standing poles 2 has a bottom side and a top side. The two side wing plates 51 of the fastener unit 5 are perpendicularly welded to a bottom side of the standing pole 2. Each of the two side wing plates 51 is configured with a through hole 511. Corresponding to the through holes 511 of the two side wing plates 51, the second primary rod 12 to be connected to the bottom side of the standing pole 2 is also configured with two through holes 121. Preferably, the inner walls of the through holes 121 are made to configure inner threads thereby. Further, the rectangular plate member 52 is configured with two through holes 521 respectively corresponding to the through holes 511 of the two side wing plates 51. Each of the screw sets 53 includes a threaded bolt and a threaded nut. The threaded bolts of the screw sets 53 are adapted for sequentially passing through the through holes 511 of the side wing plates 51, passing through the through holes 121 while matching with the inner threads configured at the inner walls of the through holes 121, and then passing through the through holes 521 of the rectangular plate members 52, and finally being locked with the threaded nuts of the screw sets 53. In such a way, the two standing poles 2 are symmetrically assembled onto the chassis 1.

In accordance with the first preferred embodiment of the present invention, the top sides of the standing poles 2 are provided with protective pads 23. The protective pads 23 are made of elastic or flexible materials, such as rubber and plastic. The protective pads 23 are adapted for protecting the user from being injured by the rigid top sides of the standing poles 2. Further, the surface of each protective pad 23 is preferably configured with a protruded pattern for providing further protection to the protective pad 23 itself.

Figure 3:
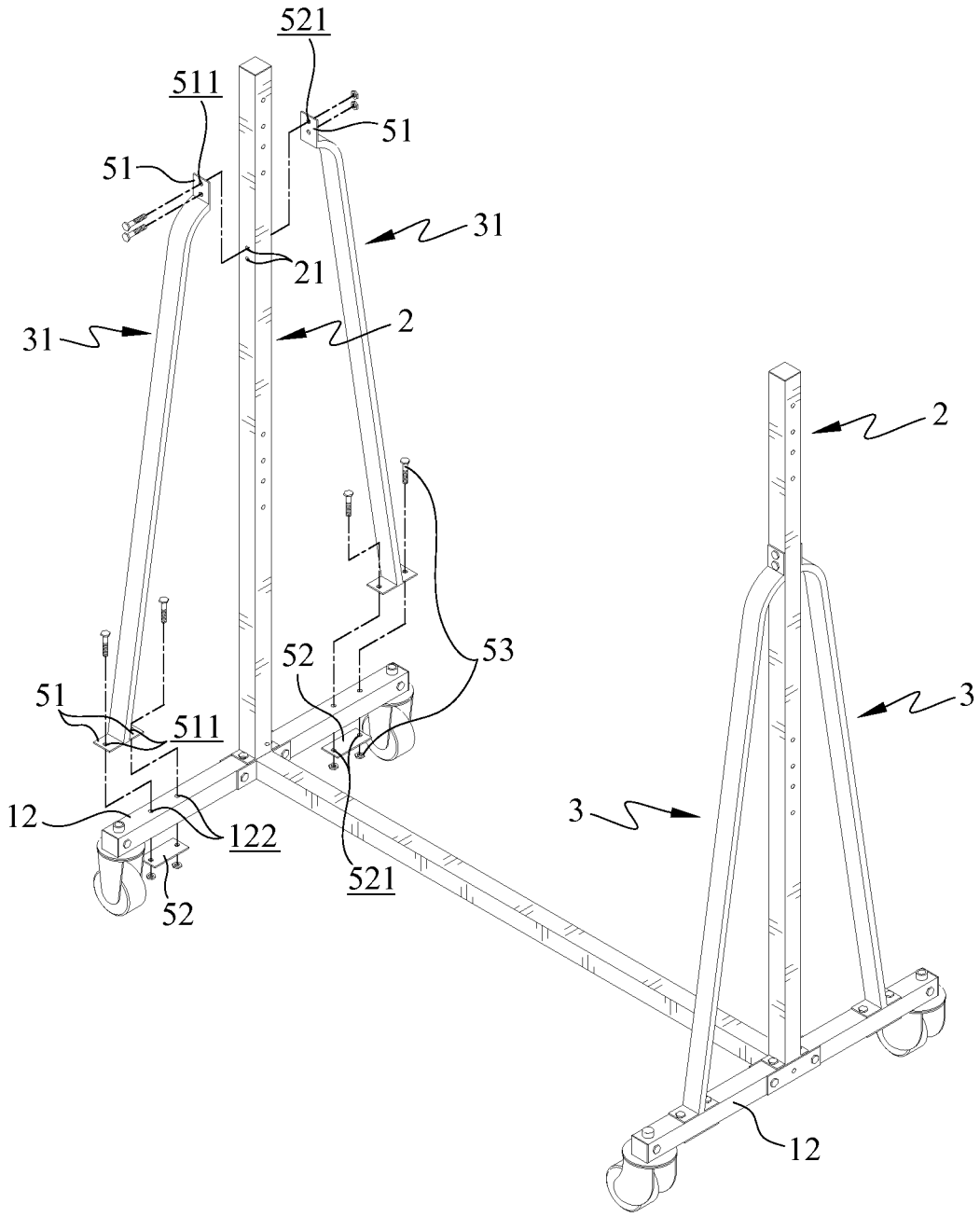
FIG. 3 is an exploded view showing the chassis, the standing poles and reinforcement sets according to the first embodiment of the present invention.

FIG. 3 is an exploded view showing the connection of the standing poles 2 and the reinforcement sets 3 according to the first embodiment of the present invention. Referring to FIG. 3, each of the reinforcement sets 3 includes two identical reinforcement rods 31. Each of the reinforcement sets 3 is connected between the standing pole 2 and the second primary rod 12 for reinforcing the strength of the connection between the standing pole 2 and the second primary rod 12. Specifically, the two reinforcement rods 31 of the reinforcement set 3 are symmetrically distributed at both sides of the standing pole 2 for connecting with two opposite sides of the second primary rod 12. Generally, the two reinforcement rods 31 of the reinforcement set 3 obliquely pull the standing pole 2 toward two opposite sides of the second primary rod 12, thus providing a reinforcement of the strength of the connection therebetween.

As shown in FIG. 3, the fastener unit 5 is provided for fastening an upper end of each of the two reinforcement rods 31 to one side surface of the standing pole 2, and another fastener unit 5 is provided for fastening a bottom end of the reinforcement rod 31 to the upper surface of the second primary rod 12. With respect to the fastener unit 5 fastening the upper end of the reinforcement rod 31 to the standing pole 2, it includes at least one side wing plate 51 welded to the upper end of the reinforcement rod 31 and parallel with the side surface of the standing pole 2. The at least one side wing plate 51 is configured with at least one through hole 511. At a corresponding position of the standing pole 2, there is configured at least one through hole 21 transversely extending through the standing pole 2. Preferably, the inner walls of the through holes 21 are made to configure inner threads thereby. Similarly and symmetrically, the upper end of another reinforcement rod 31 of the reinforcement set 3 is connected to another side surface of the standing pole 2 by another fastener unit 5. Specifically, this fastener unit 5 also includes at least one side wing plates 51 welded to the upper end of the corresponding reinforcement rod 31 and parallel with the side surface of the standing pole 2, and this at least one side wing plate 51 is configured with at least one through hole 511. In assembling operation, the through holes 511 of the side wing plates 51 extending from the upper ends of both of the reinforcement rods 31 of the reinforcement set 3 are aligned with the through hole correspondingly configured on the standing pole 2. The screw set 53 including a threaded bolt and a threaded nut is provided for fastening the upper ends of the reinforcement rods 31 and the standing pole 2, in which the threaded bolt is sequentially inserted through the through hole of the side wing plate 51 of the upper end of one reinforcement rod 31, the through hole of the standing pole 2, and the through hole of the side wing plate 51 of the upper end of the other reinforcement rod 31, and is finally locked by the threaded nut at the opposite side of the standing pole 2. When extending through the through hole 21, the threaded bolt threadedly matches with the threaded inner wall of the through hole 21.

As shown in FIG. 3, with respect to the fastener unit 5 provided for fastening a bottom end of the reinforcement rod 31 to the upper surface of the second primary rod 12, it includes a includes two side wing plates 51, a rectangular plate member 52, and two screw sets 53. The two side wing plates 51 of the fastener unit 5 are welded to the bottom end of the reinforcement rod 31. Each of the two side wing plates 51 is configured with a through hole 511. Corresponding to the through holes 511 of the two side wing plates 51, the second primary rod 12 to be connected to the bottom end of the reinforcement rod 31 is also configured with two through holes 122. Preferably, the inner walls of the through holes 122 are made to configure inner threads thereby. Further, the rectangular plate member 52 is configured with two through holes 521 respectively corresponding to the through holes 511 of the two side wing plates 51. Each of the screw sets 53 includes a threaded bolt and a threaded nut. The threaded bolts of the screw sets 53 are adapted for sequentially passing through the through holes 511 of the side wing plates 51, passing through the through holes 122 while matching with the inner threads configured at the inner walls of the through holes 122, and then passing through the through holes 521 of the rectangular plate members 52, and finally being locked with the threaded nuts of the screw sets 53. In such a way, two fastener units 5 are used to secure the bottom end of the reinforcement rod 31 to one side of the second primary rod 12. In a similar manner, the bottom end of the other one reinforcement rod 31 of the reinforcement set 3 is secured to the other side of the second primary rod 12 by another two fastener unit 5. Likewise, another reinforcement set 3 is assembled for reinforcing the strength of connection between the other standing pole 2 and the other second primary rod 12, details of which can be learnt by referring to the above description and are not to be iterated hereby.

Figure 4A:
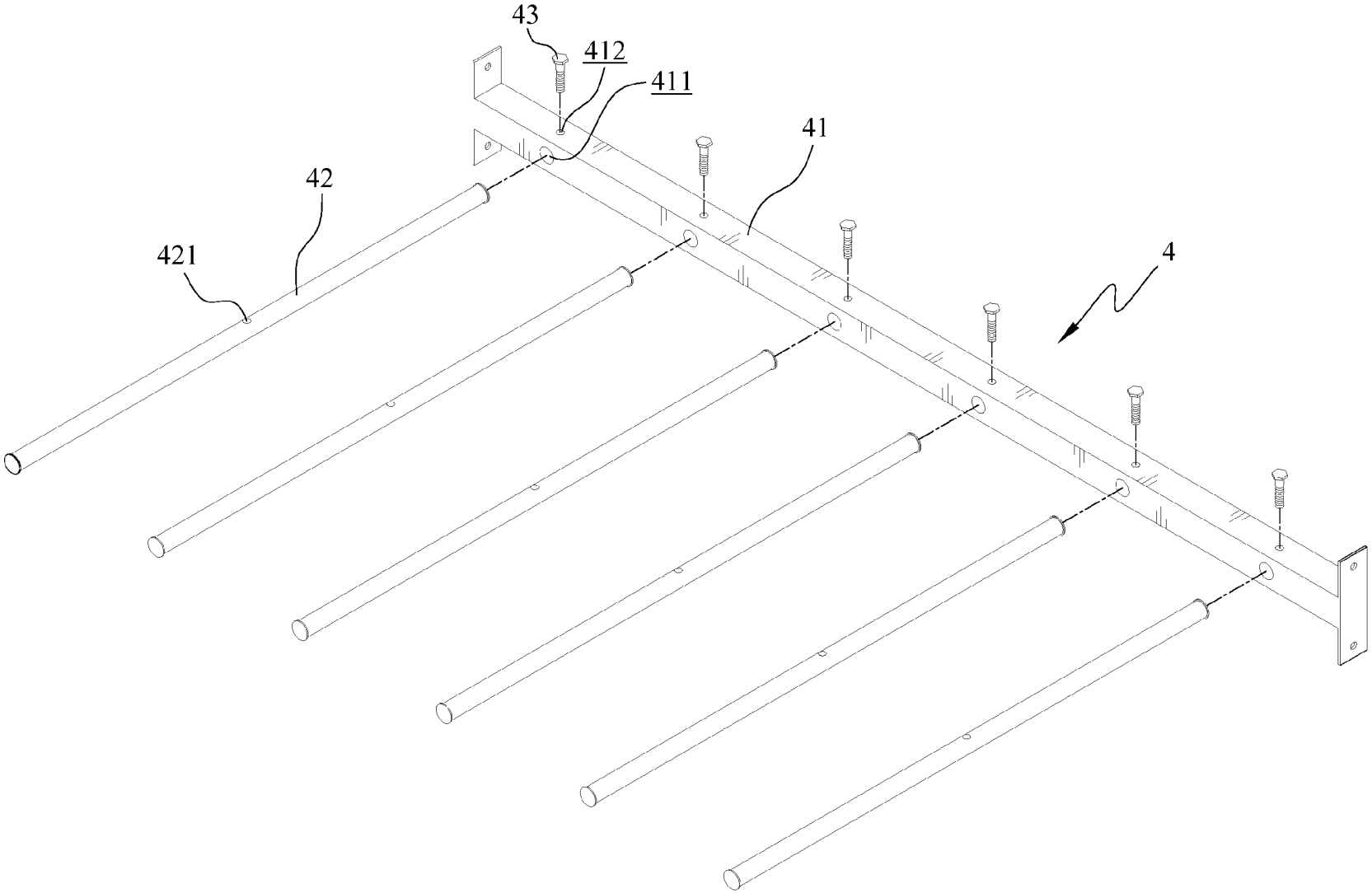
FIG. 4A is an exploded view showing a cross beam and a plurality of hanging bars of a hanging rack according to the first embodiment of the present invention.
Figure 4B:
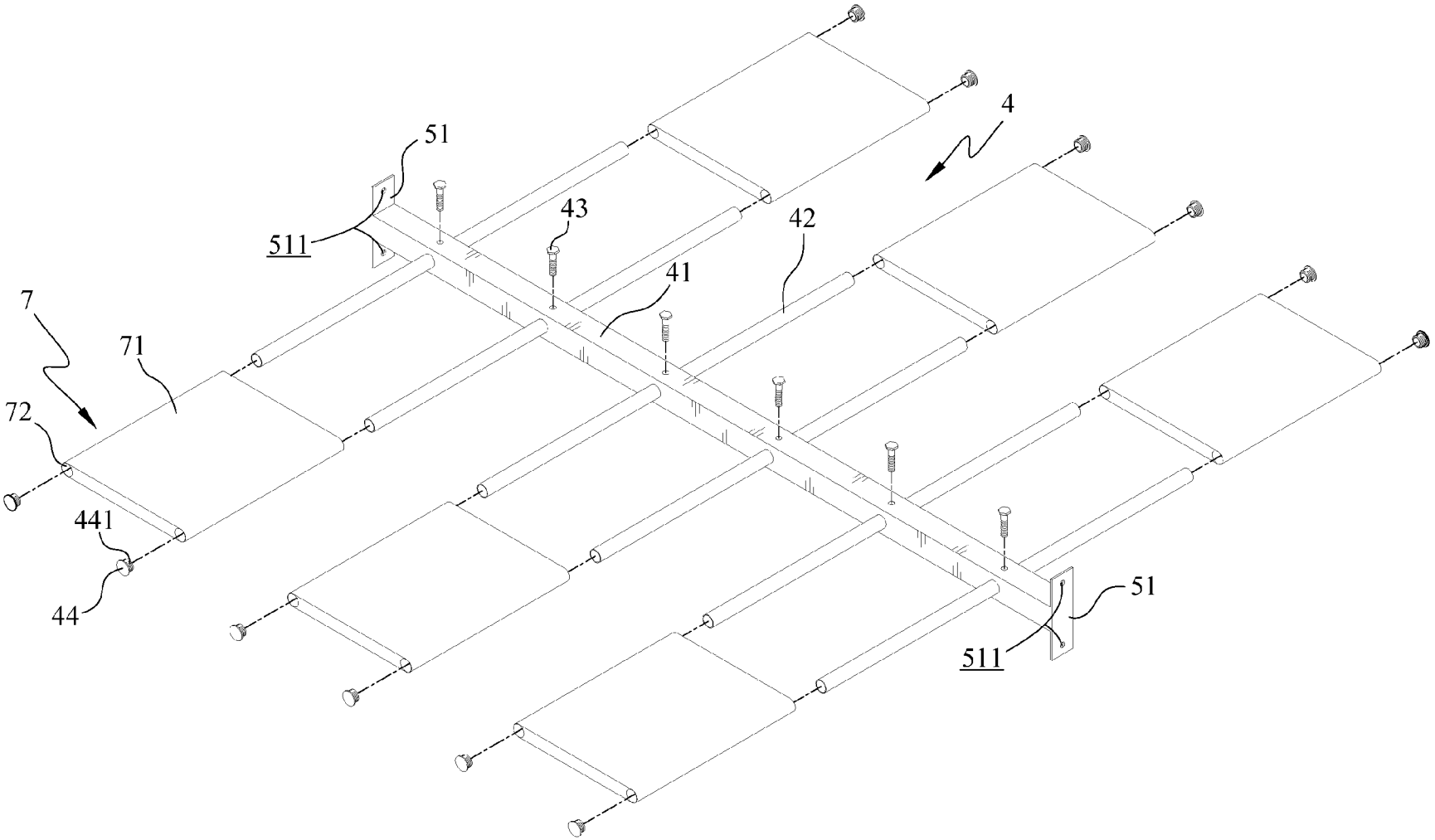
FIG. 4B is an exploded view showing the cross beam, the hanging bars and a plurality of pad sets according to the first embodiment of the present invention.
Figure 4C:
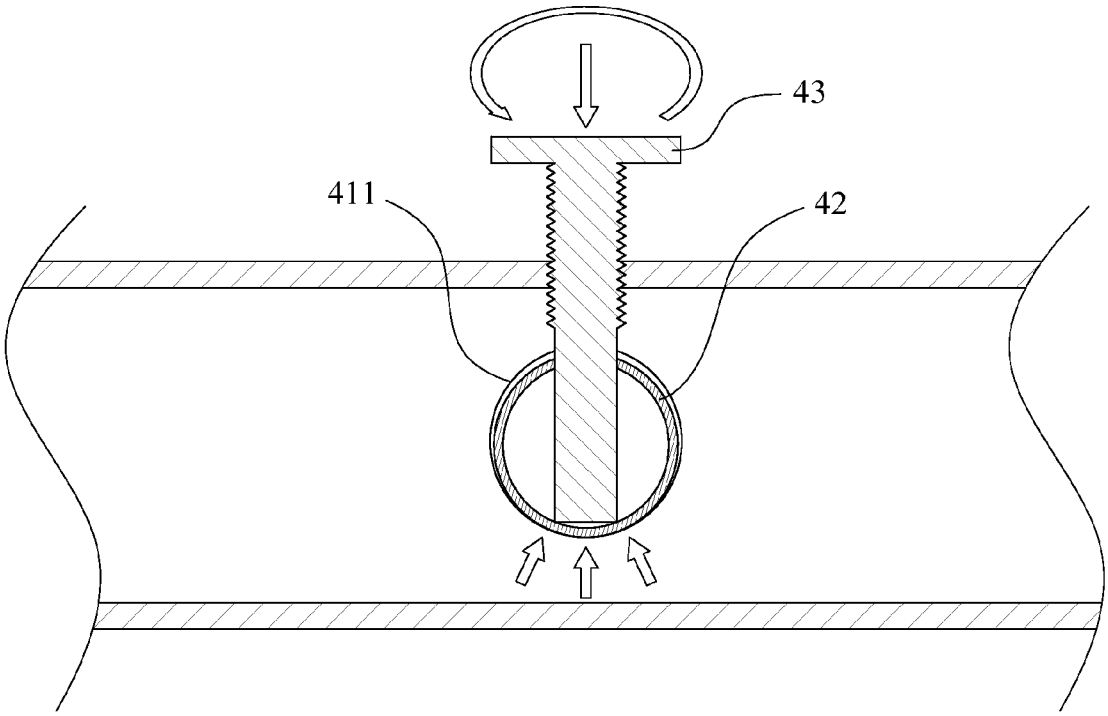
FIG. 4C is a cross sectional view showing the hanging bar being secured to the cross beam by a screw bolt according to the first embodiment of the present invention.
Figure 5:
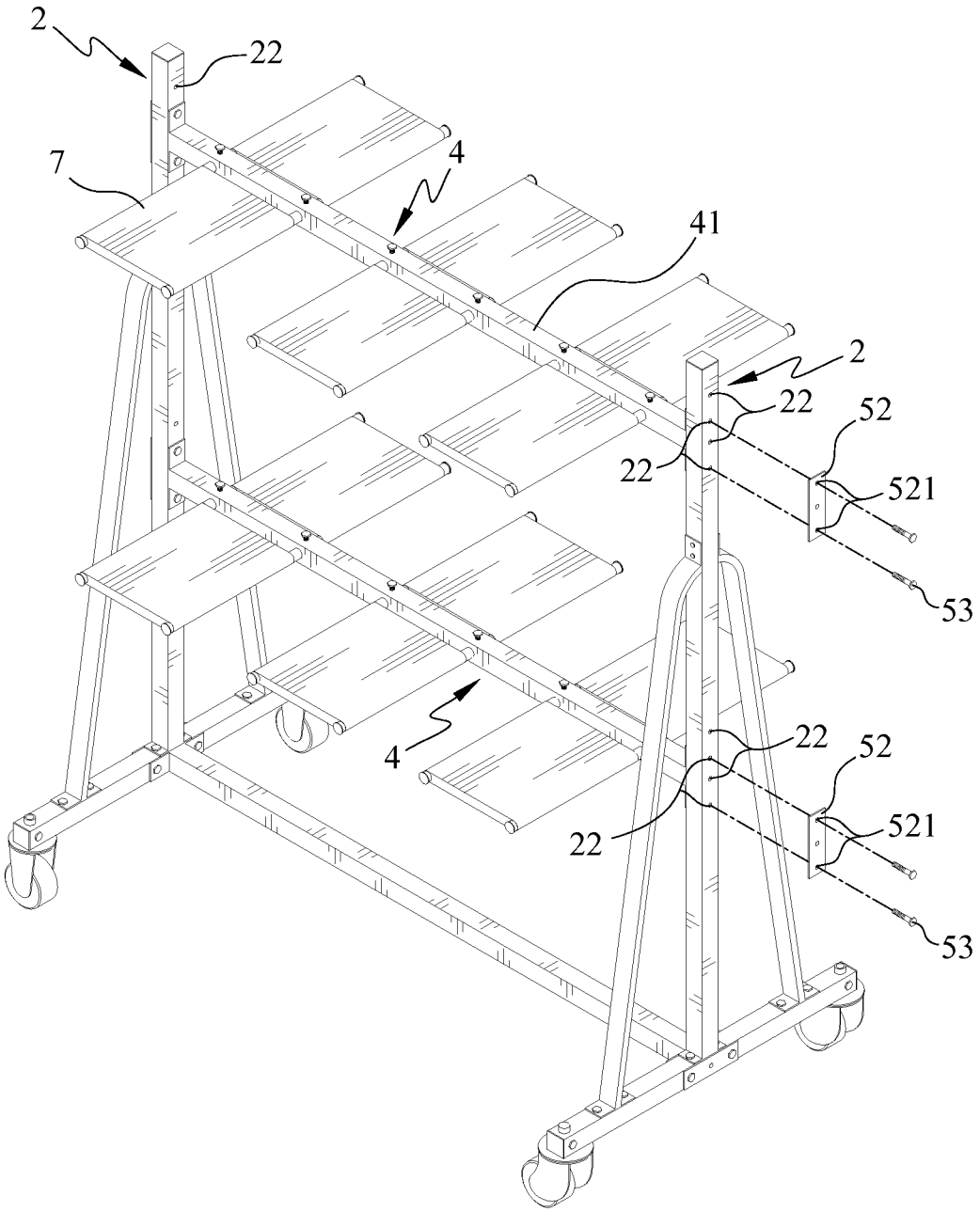
FIG. 5 is an exploded view showing the hanging cart for carrying and storing folding chairs according to the first embodiment of the present invention.

FIG. 4A is an exploded view showing one of the hanging racks 4 according to the first embodiment of the present invention. Each of the hanging rack 4 includes a cross beam 41 and a plurality of hanging bars 42. FIG. 4B is an exploded view showing the hanging bars 42, the protective caps 44 and the pad sets 7 according to the first embodiment of the present invention. FIG. 4C is a cross sectional view showing the hanging bar 42 being secured to the cross beam 41 by screw bolts 43 according to the first embodiment of the present invention. FIG. 5 is an exploded view showing the connection of the standing poles 2 and the hanging racks 4 according to the first embodiment of the present invention.

Referring to FIG. 5 and further referring to FIGS. 4A through 4C, it can be seen that the disassemblable hanging cart for carrying and storing folding chairs can be provided with a plurality of hanging racks 4. However, the exact quantity of hanging racks 4 provided is mostly determined in accordance with the specific height of the standing poles 2. In the first embodiments shown in the foregoing drawings, it is exemplified that there are two hanging racks 4 provided. As shown in FIG. 4A, each of the hanging rack 4 includes the cross beam 41 and a plurality of hanging bars 42 perpendicularly crossing the cross beam 41. The cross beam 41 has two opposite ends. One end of the cross beam 41 is adapted for being connected to one standing pole 2 and another end of the cross beam 41 is adapted for being connected to the other standing pole 2. The cross beam 41 is configured with a plurality of horizontal through holes 411 horizontally and transversely extending through the cross beam 41, and a plurality of vertical through holes 412 vertically and transversely extending through an upper wall of the cross beam 41 and located corresponding to the horizontal through holes 411. Preferably, the inner wall of each of the vertical through holes 412 is made with inner threads. The hanging bars 42 are configured in a hollow round tube shape. Each of the hanging bars 42 is configured with a vertical hole 421 at a central position thereof. The hanging bars 42 are allowed to be inserted through the horizontal through holes 411 of the cross beam 41, such that the vertical holes 421 of the hanging bars 42 are aligned with the vertical through holes 412 of the cross beam 41. Preferably, the vertical through holes 412 are made with inner threads thereby. In such a way, as shown in FIG. 4C, a plurality of threaded bolts 43 are inserted though and threadedly matched with the vertical through holes 412, and are further inserted though the vertical holes 421 of the hanging bars 42. The bolts 43 force the hanging bars 42 to move downwards such that the hanging bars 42 contact with the lower side walls of the through holes 411 of the cross beam 41. Thus, the front ends of the threaded bolts 43 interfere with inner walls of the hanging bars 42, so as to apply pressing forces thereto. In such a way, the hanging bars 42 are securely fixed with the cross beam 41.

In according with the first embodiment of the present invention, the pad set 7 includes a covering pad 71 and two pad connection holes 72 disposed at two sides of the covering pad 71. The sizes and locations of the pad connection holes 72 are corresponding to the hanging bars 42. As shown in FIG. 4B, two of the immediately adjacent hanging bars 42 are inserted into the two corresponding pad connection holes 72 of the covering pad 71, thereby connecting two hanging bars 42 with one pad set 7. According to a second embodiment of the present invention, the pad set 7 may include a covering pad 71 and three pad connection holes 72 disposed in the covering pad 71 (not shown in drawings). The sizes and locations of the pad connection holes 72 are corresponding to the hanging bars 42. Three of the immediately adjacent hanging bars 42 are inserted into the three corresponding pad connection holes 72 of the covering pad 71. Thus, each one of the pad sets 7 is mounted onto three immediately adjacent hanging bars 42. In according with a third embodiment of the present invention, the pad set 7 may include a covering pad 71 and there is only one pad connection hole 72 disposed in the covering pad 71 (not shown in drawings). The size of the pad connection hole 72 is corresponding to the hanging bars 42. Each of the hanging bars 42 has one covering pad 71 mounted thereto, thereby connecting the hanging bars 42 with the pad sets 7. Because the hanging bars 42 are usually made of metal tubes, the friction forces between the hanging bars 42 and the folding chairs are metal-metal interface friction force, which is small. Thus, it makes the folding chairs more likely be fallen out of the hanging cart while moving the hanging cart from place to place. The present invention uses the pad sets 7 to increase the friction forces. The covering pads 71 may be made of a cushion, fabric, rubber, plastic or any material that can provide sufficient friction force to prevent the folding chairs from falling off the hanging cart according to the present invention. The covering pad 71 may also take advantage of physical structures or shapes to increase the friction forces, such as ridges, grooves or wavy shapes.

In accordance with the first preferred embodiment of the present invention, both ends of each hanging bars 42 are provided with protective pads 44. The protective pads 44 are made of elastic or flexible materials, such as rubber and plastic. The protective pads 44 are adapted for protecting the user from being injured by the rigid end sides of the hanging bars 42. Further, the surface of each protective pad 44 is preferably configured with a protruded pattern 441 for providing further protection to the protective pad 123 itself. Furthermore, the protective pad 44 may secure the covering pad 71 on the hanging bar 42.

Further, as shown in FIGS. 4B and 5, each hanging rack 4 is secured to the two standing poles 2 by fastener units 5. The fastener unit 5 includes two side wing plates 51, a rectangular plate member 52, and two screw sets 53. The cross beam 41 has two opposite end sides, and each of the two opposite end sides of the cross beam 41 is connected to one of the two standing poles 2 by the fastener unit 5. The two side wing plates 51 of the fastener unit 5 are perpendicularly welded to the end side of the cross beam 41. Each of the two side wing plates 51 is configured with a through hole 511. Corresponding to the through holes 511 of the two side wing plates 51, the standing poles 2 to be connected to the end side is also configured with an assembly portion 22. The assembly portion 22 includes at least two through holes transversely configured through the standing poles 2. Preferably, the inner walls of the through holes of the assembly portions 22 are made to configure inner threads thereby. Further, the rectangular plate member 52 is configured with two through holes 521 respectively corresponding to the through holes 511 of the two side wing plates 51. Each of the screw sets 53 includes a threaded bolt and a threaded nut. The threaded bolts of the screw sets 53 are adapted for sequentially passing through the through holes 521 of the rectangular plate members 52, passing through the through holes of the assembly portions 22 while matching with the inner threads configured at the inner walls thereof, and then passing through the through holes 511 of the side wing plates 51, and finally being locked with the threaded nuts of the screw sets 53. In such a way, the hanging rack 4 can be conveniently secured between two standing poles 2. However, it should be noted that the quantity of the hanging racks is not restricted by the present invention, and also the quantity of the assembly portions 22 is not restricted by the present invention. For example, alternative assembly portions 22 may be configured adjacent to the original assembly portions 22 for allowing adaptive adjustment of the height of the hanging rack 4 according to the height of the folding chairs. Therefore, the disassemblable hanging cart according to the present invention may carry and store various folding chairs with different sizes.

Further, it is worth mentioning that the parts of the disassemblable hanging cart for the folding chairs are exemplified as but not restricted to be assembled or connected by fastener units 5 as illustrated above. Any other approach adapted for convenient assemble and disassemble operation can be used. Furthermore, the quantities of the through holes and threaded bolts employed for the fastener units are not restricted by the present invention.

Figure 7:
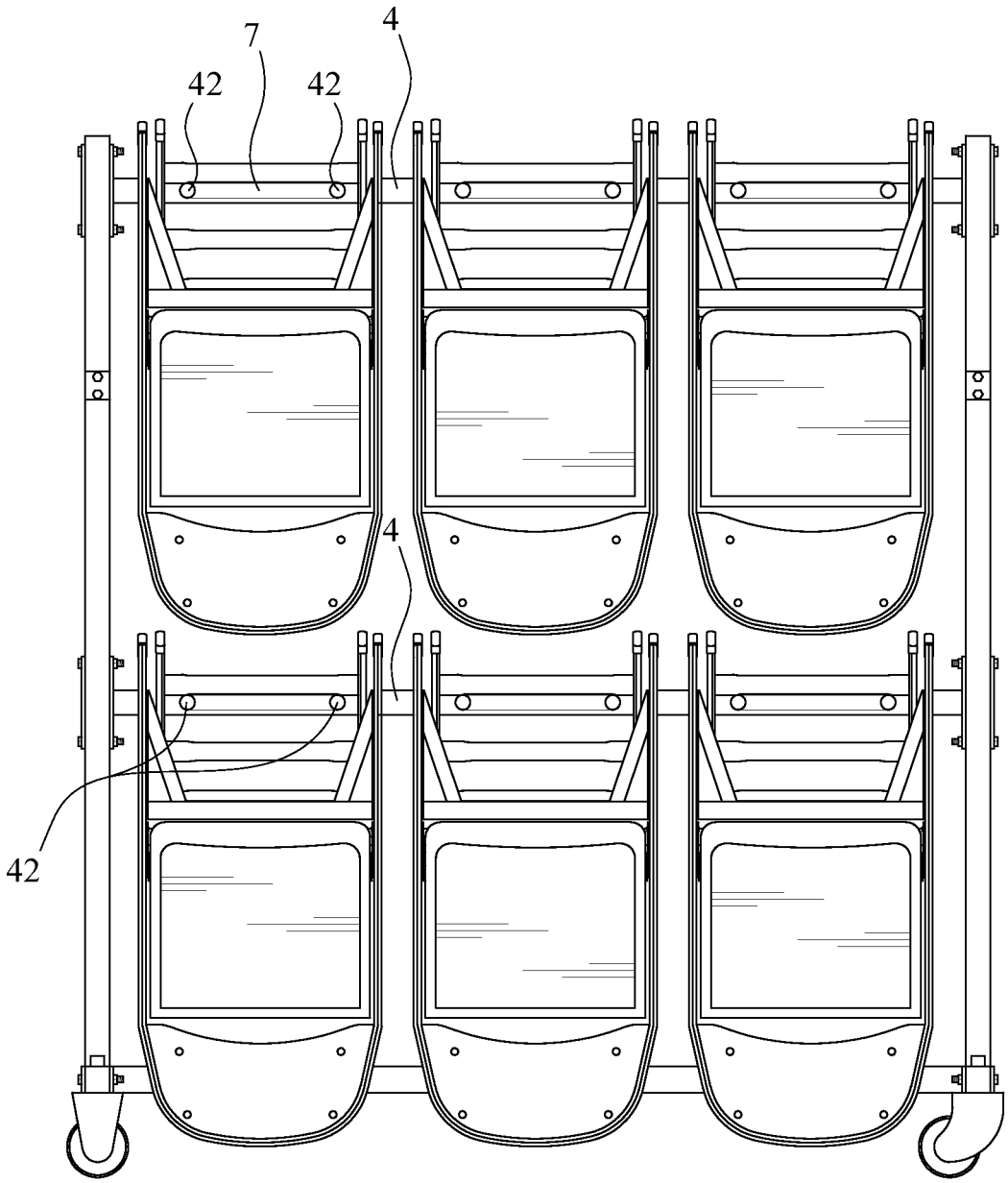
FIG. 7 is a front view showing the operation status of the disassemblable hanging cart for carrying and storing folding chairs, in which a plurality of folding chairs are accommodated on the disassemblable hanging cart.
Figure 8:
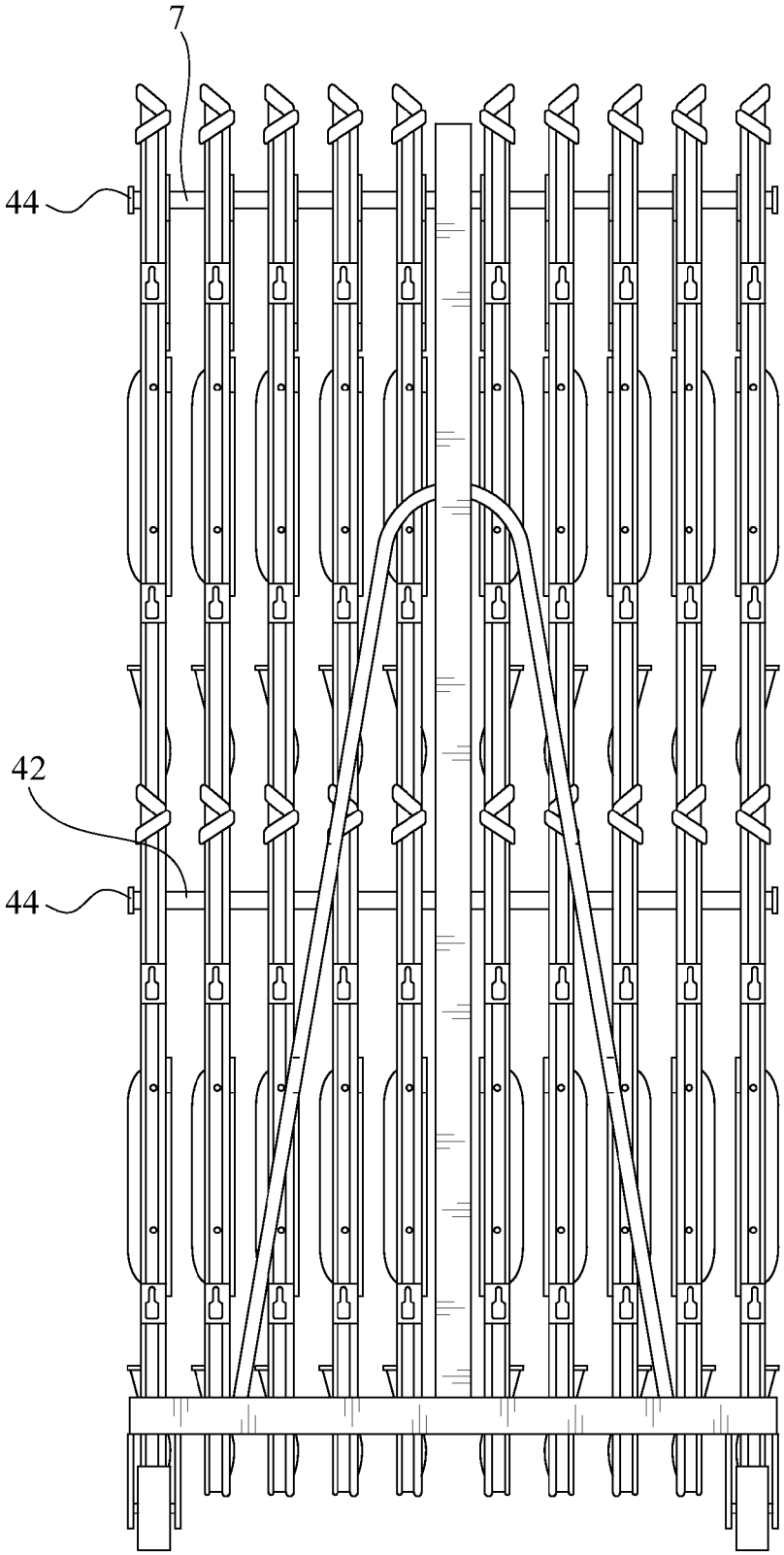
FIG. 8 is a side view showing the disassemblable hanging cart for carrying and storing folding chairs of FIG. 7.
Figure 9:
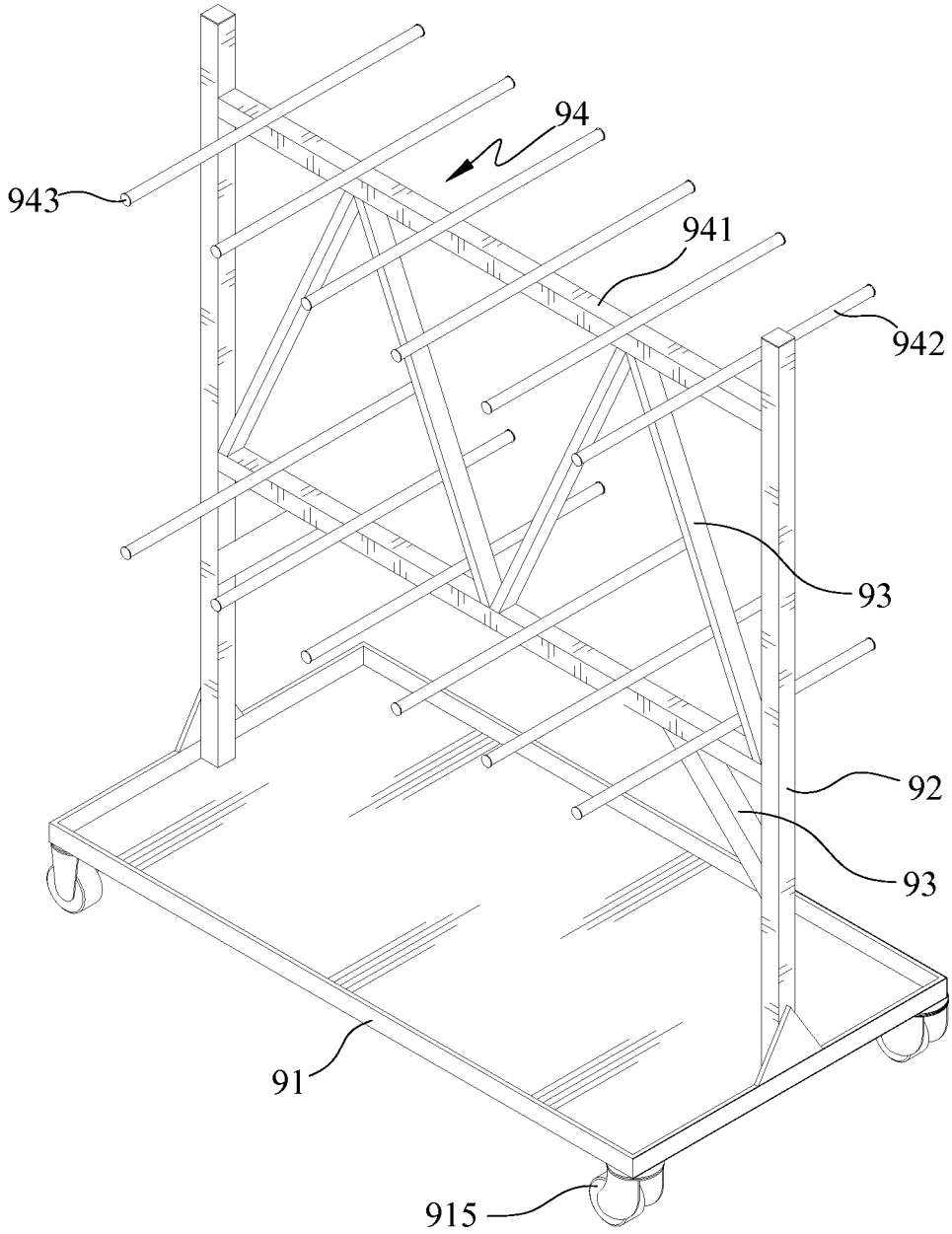
FIG. 9 ( Prior Art )
FIG. 9 is a perspective view showing a conventional hanging cart for carrying and storing folding chairs.

FIG. 7 illustrates the operation status of the disassemblable hanging cart for folding chairs, in which a plurality of folding chairs are accommodated on the disassemblable hanging cart for the folding chairs. FIG. 8 is a side view of operation status of FIG. 7. Referring to FIGS. 7 and 8, according to the first embodiment, the present invention is illustrated as including two hanging racks 4. Both sides of the hanging bars 42 of the hanging racks 4 can be used for hanging the folding chairs. In operation, according to the sizes of the folding chairs to be hung, two or three immediately adjacent hanging bars 42 are used for hanging one folding chair. In other words, when hanging the folding chairs in smaller size, the covering pad 71 having two pad connection holes 72 are mounted to two of the immediately adjacent hanging bars 42 to hang the folding chairs. When hanging the folding chairs in larger size, the covering pad 71 having three pad connection holes 72 are mounted to three of the immediately adjacent hanging bars 42 to hang the folding chairs. In such a way, the disassemblable hanging cart for the folding chairs can be used for carrying and storing a plurality of folding chairs in different sizes at the same time. The hanging bars 42 may also be distributed more closely and the folding chairs may be hung at four, five, or more immediately adjacent hanging bars 42. When the folding chairs are hung on the hanging bars 42, the folding chairs are rest on the pad sets 7, which provides friction forces to prevent the folding chairs from falling off the hanging cart. According to the third embodiment of the present invention (not shown in drawings), the covering pad 71 having a singular pad connection hole 72 is mounted to the hanging bar 42, which is capable of hanging the folding chairs in various sizes and does not need to replace the covering pads 71 due to the sizes of the folding chairs. However, the friction forces provided by the covering pads 71 according to the first and second embodiments are different from that provided by the covering pads 71 according to the third embodiment. The pad sets 7 provide friction forces and therefore effectively prevent the folding chairs from falling out of the hanging cart according to the present invention. As shown in FIGS. 7 and 8, the protective pads 44 provided at the ends of the hanging bars 42 are configured with protruded edges, which are adapted for stopping the folding chairs loaded thereby from falling off from the disassemblable hanging cart for the folding chairs.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A disassemblable hanging cart for carrying and storing folding chairs, comprising:

a chassis;

a plurality of caster sets distributed in different positions of the chassis for providing a stable support for the disassemblable hanging cart;

two standing poles, vertically and symmetrically erected on opposite positions of the chassis, wherein each of the two standing poles is configured with a plurality of assembly portions, each assembly portion of a first of the two standing poles is corresponding to one of the assembly portions of a second of the two standing poles, and the assembly portions of each standing pole are located at different heights and positions;

two reinforcement sets, wherein each reinforcement set is provided between one of the two standing poles and the chassis for reinforcing the connection strength therebetween;

a plurality of rectangular plate members each having a through hole; and a plurality of screws that extend through the plurality of rectangular plate members;

a plurality of hanging racks, wherein each hanging rack comprises a cross beam having a plurality of horizontal holes and a plurality of hanging bars, each cross beam has two opposite ends, and each of the hanging bars crossover a corresponding cross beam through one of the plurality of horizontal holes and is perpendicular to the corresponding cross beam, and the opposite ends of each cross beam are secured at corresponding assembly portions of the standing poles, so that the cross beams are positioned on the standing poles at different heights, both ends of each hanging bar are configured for hanging one or more folding chair, each cross beam includes a plurality of vertical holes, and each hanging bar includes a vertical hole that is aligned with one of the vertical holes of the corresponding cross beam, wherein each cross beam has a side wing plate at each of its opposite ends, and which is disposed to be perpendicular to a longitudinal direction of the cross beam, each cross beam being secured at the corresponding assembly portion by the side wing plates which each have a through hole, a corresponding rectangular plate member placed on an opposite side of the vertical standing pole from the side wing plate, and a corresponding screw that extends through both through holes and the vertical standing pole to secure the cross beam;

a plurality of bolts, wherein each bolt is inserted through the vertical hole of one of the hanging bars and the corresponding vertical hole of the cross beam such that an end face of the bolt interferes with an inner wall of the hanging bar to apply a force thereto and keep the hanging bar in a fastened position; and a plurality of pad sets, wherein each pad set has a covering pad, each covering pad is mounted and secured to at least one of the hanging bars, when the folding chairs are hung on the hanging bars, the covering pads contact with the folding chairs and provide friction forces, which are greater than a friction force that would occur between the folding chairs and hanging bars, to prevent the folding chairs from falling off from the hanging cart.

2. The disassemblable hanging cart as claimed in claim 1, wherein each caster set comprises a swivel-axle extending through the chassis and being perpendicular to the chassis, and a threaded bolt is provided for horizontally extending through the chassis and the swivel-axle for securing the caster set to the chassis.

3. The disassemblable hanging cart as claimed in claim 1, wherein each standing pole is secured to the chassis by a fastener unit.

4. The disassemblable hanging cart as claimed in claim 1, wherein each of the cross beams is secured to the standing poles by fastener units.

5. The disassemblable hanging cart as claimed in claim 1, wherein each reinforcement set is secured to the corresponding standing pole by a fastener unit, and each reinforcement set is secured to the chassis by an additional fastener unit.

6. The disassemblable hanging cart as claimed in claim 5, wherein each reinforcement set comprises two reinforcement rods symmetrically distributed at both sides of the standing pole, the two reinforcement rods are secured to the standing pole and the chassis by fastener units, and the two reinforcement rods of the reinforcement set obliquely pull the standing pole toward two opposite sides of the chassis for providing a reinforcement of the strength of the connection therebetween.

7. The disassemblable hanging cart as claimed in claim 1, wherein the plurality of horizontal holes of each cross beam extend horizontally through the cross beam.

8. The disassemblable hanging cart as claimed in claim 1, wherein an inner wall of each vertical hole of each cross beam is threaded, and each bolt in threaded to match the threads of the inner wall of the corresponding vertical hole.

9. The disassemblable hanging cart as claimed in claim 1, wherein each end of each hanging bar includes a protective pad to protect a user from being injured by the end of the hanging bar, each protective pad having a protruding pattern configured to stop a folding chair loaded on the hanging bar from falling off from the disassemblable hanging cart.

10. The disassemblable hanging cart as claimed in claim 1, wherein the inner wall of the vertical hole of each hanging bar includes a non-threaded portion that extends along a length of the inserted bolt, the corresponding inserted bolt including a portion having a plurality of threads that does not touch the non-threaded portion of the inner wall, the end of the corresponding inserted bolt interfering with the non-threaded portion of the inner wall to apply the force thereto and keep the hanging bar in a fastened position.

11. The disassemblable hanging cart as claimed in claim 1, wherein each of the hanging bars is a hollow round tube.

12. The disassemblable hanging cart as claimed in claim 1, wherein the covering pad includes a cushion.

13. The disassemblable hanging cart as claimed in claim 1, wherein the covering pad includes a plurality of ridges or grooves.

14. The disassemblable hanging cart as claimed in claim 1, wherein the covering pad includes two pad connection holes disposed therein, the hanging bars are inserted into the pad connection holes so that the covering pad is mounted to the two immediately adjacent hanging bars.

15. The disassemblable hanging cart as claimed in claim 1, wherein the covering pad includes three pad connection holes disposed therein, the hanging bars are inserted into the pad connection holes so that the covering pad is mounted to the three immediately adjacent hanging bars.

16. The disassemblable hanging cart as claimed in claim 1, wherein the covering pad includes a singular pad connection hole disposed therein, the hanging bar is inserted into the pad connection hole so that each hanging bar has one covering pad mounted thereto.

* * * * *